United States Patent [19]

Boop

[11] 4,007,796

[45] Feb. 15, 1977

[54] EXPLOSIVELY ACTUATED WELL TOOL HAVING IMPROVED DISARMED CONFIGURATION

[76] Inventor: Gene T. Boop, 3938 Capri, Corpus Christi, Tex. 78415

[22] Filed: Dec. 23, 1974

[21] Appl. No.: 535,355

[52] U.S. Cl. ..... 175/4.55; 102/21; 200/1 R

[51] Int. Cl.[2] ..... E21B 43/116

[58] Field of Search ..... 102/21.6, 61.08; 166/55.2, 297; 175/4.55, 4.56

[56] References Cited

UNITED STATES PATENTS

| | | | |
|---|---|---|---|
| 2,543,823 | 3/1951 | Barry | 200/61.08 |
| 2,620,029 | 12/1952 | Turechek et al. | 175/4.56 |
| 3,208,378 | 9/1965 | Boop | 175/4.55 |
| 3,327,792 | 6/1967 | Boop | 175/4.55 |
| 3,768,408 | 10/1973 | Hallmark | 175/4.55 |
| 3,773,120 | 11/1973 | Stroud et al. | 175/4.55 |

FOREIGN PATENTS OR APPLICATIONS

| | | | |
|---|---|---|---|
| 680,132 | 2/1964 | Canada | 102/21.6 |

*Primary Examiner*—Ernest R. Purser
*Assistant Examiner*—Richard E. Favreau
*Attorney, Agent, or Firm*—G. Turner Moller

[57] ABSTRACT

There is disclosed a single wire multiple shot selective fire perforating gun for piercing oil field tubular goods, typically during the process of completing an oil or gas well. A switch in the gun electrically isolates an associated blasting cap and short circuits the terminals thereof until the associated blasting cap and perforating element are armed. A plurality of blasting cap-perforating element assemblages are vertically disposed on the tool with the detonation of one perforating element arming the next adjacent blasting cap.

12 Claims, 5 Drawing Figures

EXPLOSIVELY ACTUATED WELL TOOL HAVING IMPROVED DISARMED CONFIGURATION

The art of perforating oil field tubular goods is rather well developed. The two basic types of perforating guns are the bullet and shaped charge. In bullet type perforators, a metal bullet is fired through the casing, through the cement sheath surrounding the casing and into the formation adjacent thereto. In a shaped charge type gun, the shaped charge burns a hole in the casing, in the cement sheath and partially into the formation therearound. Although both type guns have their advantages, the shaped charge type is at present somewhat more common. This invention is usable with either type gun and is designed to selectively fire one perforating element or a small group of elements out of a plurality of elements on the gun.

There are a number of different techniques for selectively firing perforating elements on a perforating gun containing additional perforating elements. The simplest type is often called a "two gun tandem" in which approximately half of the perforating elements are connected to a source of D.C. voltage through a diode of one polarity and the remaining perforating elements are connected to the source of D.C. voltage through a diode of opposite polarity. Applying a firing current of one polarity to the gun fires the first group of perforating elements while the second group is fired upon applying firing current of opposite polarity thereto. Although this technique is extremely simple, it lacks flexibility since one cannot, for example, assemble a series of eighty perforating elements and selectively fire only a few at a time.

In many petroleum producing areas of the world, producing formations of substantial thickness are encountered in which relatively thin streaks thereof contain hydrocarbon saturations and exhibit sufficient permeability to warrant completing. It is present practice to selectively perforate only those streaks or sections which exhibit both hydrocarbon saturation and permeability. Since such streaks may be numerous but thin and separated from each other by unproductive sections, it is desirable to provide a perforating gun which may carry a large number of perforating elements which may be selectively fired in very small groups.

In response to this need, multiple wire - multiple shot perforating guns were devised. In these devices, a plurality of separate circuits are employed to fire a like plurality of small groups of perforating elements. Although this type device works reasonably well, there are understandable complexities involved in providing a large number of circuits in guns which may be no more than about 1½ inches in diameter. In particular, it is somewhat difficult to seal all of the wiring against liquid leakage. Since many blasting caps have a safety feature whereby they refuse to fire if wet, it will be apparent that numerous problems can attend the manufacture and use of multiple wire - multiple shot perforating guns.

In response to these difficulties, there has been developed a single wire-multiple shot gun. In devices of this type, there are provided a plurality of spaced normally disarmed blasting cap-perforating element assemblages and an armed assemblage. When the armed assemblage is fired, the adjacent blasting cap-perforating element assemblage is armed through the use of a mechanically operated switch. It is this type of selective firing perforating gun that this invention most nearly relates. There are several disadvantages of the prior art single wire-multiple shot guns. First, the initiator or blasting cap is connected through a diode to a hot wire carrying a D.C. firing voltage. A switch breaks the circuit leading through the diode and blasting cap and is used to connect contacts of a bypass circuit around the blasting cap. Accordingly, when firing current is imposed on the bypass, firing current is presented to the blasting cap which is presumably disarmed through an open circuit. If the blasting cap is inadvertantly grounded or if the diode is inadvertantly grounded, inadvertant firing of the blasting cap and its associated perforating element occurs. This can be a very serious event. If the inadvertant shot occurs above ground, obvious injury to personnel and damage to equipment may occur. If the inadvertant shot occurs below ground, it must be squeezed off since the well may make significant quantities of water. If everything goes well, only a few thousand dollars may repair the inadvertant shot. If events proceed from bad to worse, in accordance with Murphy's law, a great deal of money may be spent in repairing the inadvertant shot.

Another disadvantage of the prior art single wire-multiply shot guns is that the mechanically operated switches which act to arm each perforating element in response to firing of the next adjacent element, are destroyed upon use. Accordingly, when the gun is taken to the shop for reloading, the perforating elements, the blasting cap initiators, the mechanically operated switches and the mechanical operators therefor must all be replaced. Since the switches and mechanical operators therefor are generally more expensive than the blasting caps and perforating elements, reloading of the guns is more expensive than may be thought.

It is an object of this invention to provide a selective fire perforating gun and a switch therefor in which an initiator is electrically separated from contact with a firing circuit until the initiator is armed and ready to fire whereupon the initiator is placed in circuit with the firing mechanism.

Another object of the invention is to provide a perforating gun and switch therefor which acts to short circuit the terminals of the initiator until the initiator is armed whereupon the short circuit between the initiator terminals is interrupted.

Another object of the invention is to provide a selective fire perforating gun incorporating a reusable switch.

Another object of the invention is to provide an improved switch for use in selective fire perforating guns.

Another object of the invention is to provide an explosively actuated well tool having an improved disarmed configuration.

In summary, one aspect of the invention comprises a perforating gun including a plurality of normally disarmed electrically firable initiator-perforating element assemblages and an armed assemblage; and means for sequentially firing the assemblages including circuit means for electrically firing armed assemblages, means associated with each disarmed assemblage for electrically separating the disarmed assemblages from contact with the firing circuit means, means responsive to firing of each armed assemblage for arming one of the normally disarmed assemblages including means placing the initiator of the one disarmed assemblage in circuit with the firing circuit means.

In summary, another aspect of the perforating gun of this invention comprises a plurality of normally disarmed electrically firable initiator-perforating element assemblages and an armed assemblage; and means for sequentially firing the assemblages including circuit means for electrically firing armed assemblages, means associated with each disarmed assemblage for short circuiting the initiator thereof, and means responsive to firing of each armed assemblage for arming one of the normally disarmed assemblages including means deactivating the short circuiting means of the initiator of the one disarmed assemblage.

In summary, another aspect of this invention comprises a switch for use in a perforating gun comprising a housing; a first switch section comprising first, second and third electrically separated terminals on one side of the section for respective connection with a hot wire and a pair of initiator leads, and first, second and third electrically separated electrically conductive members on the other side of the terminal in respective electrical contact with the first, second and third terminals; and a second switch section, means mounting the first and second switch sections on the housing for relative linear movement between first and second positions, and means responsive to an event exterior of the housing for moving the switch sections from the first switch position to the second switch position, the second switch section comprising a fourth terminal and means placing the first and fourth terminals in electrical contact in the first switch position, means electrically separating the second and third terminals from the first and fourth terminals in the first switch position, and means placing the second and third terminals in circuit with the first terminal in the second switch position.

In summary, another facet of this invention comprises an explosively actuated well tool comprising an elongate casing, runable into a well, having a pair of electrical terminals; firing circuit means including a hot line and a ground line for electrically firing the device; means associated with the device for electrically separating the terminals from contact with the hot line and the ground line thereby disarming the device; and means for arming the device in the well including means for placing the terminals of the device in circuit with the firing circuit means including the hot line and the ground line.

Figure 1:
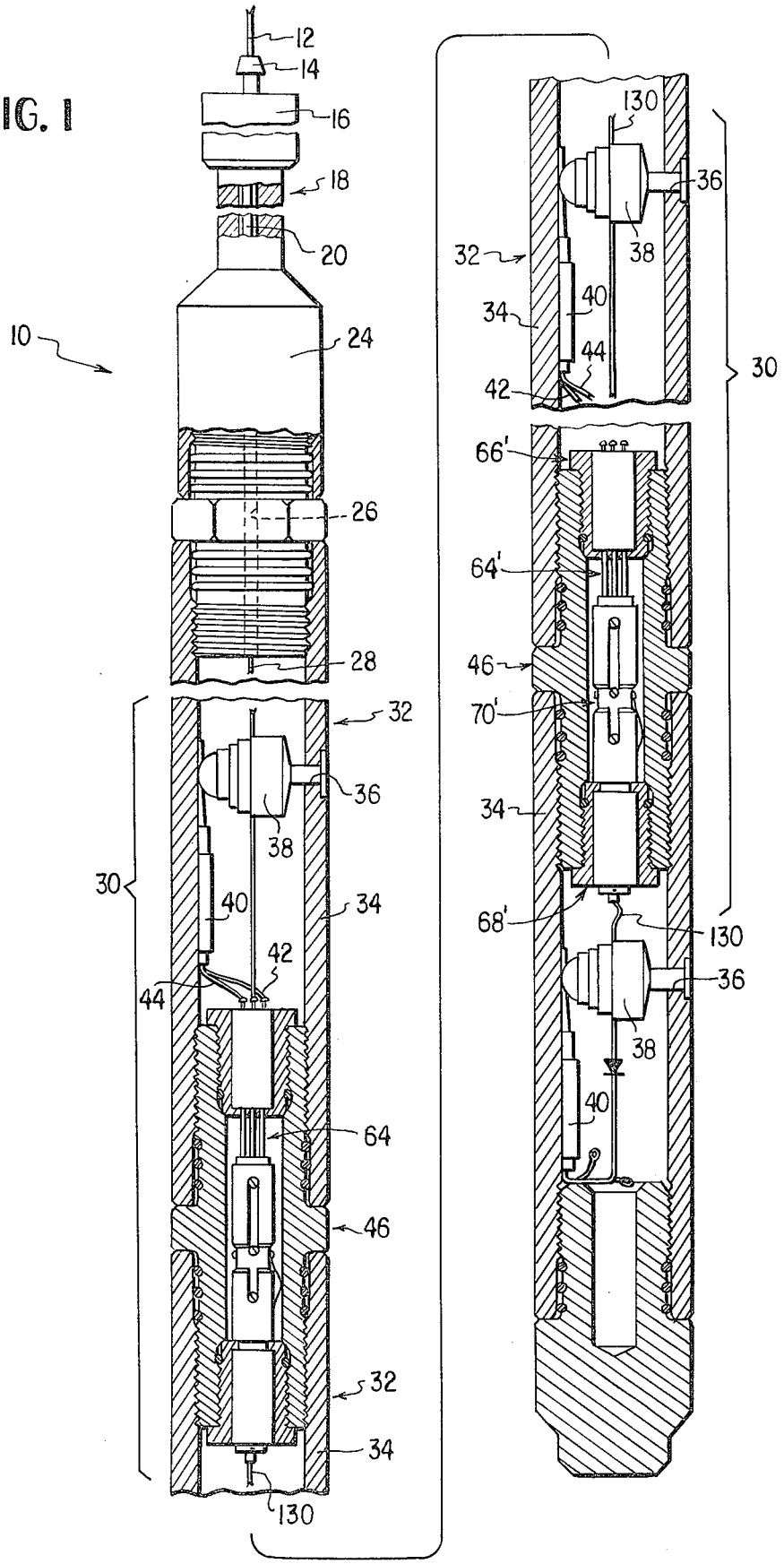
FIG. 1 is a side view, mainly in section, of a perforating gun manufactured in accordance with the principles of this invention.

Referring to FIG. 1, there is illustrated a perforating gun 10 which is raised and lowered in a well by manipulation of a suitable cable 12 designed to carry electrical current to various electrical devices in the gun 10. The cable 12 is connected to a suitable rope socket 14 which is conveniently screwed into the top of a conventional collar locator 16. As will be apparent to those skilled in the art, the collar locator 16 is designed to sense a collar or joint between adjacent pipe sections in order to properly locate the tool 10. The collar locator 16 is attached to a firing head assembly 18.

The firing head assembly head 18 may be of conventional design and provides an internal insulated electrical path 20 which is connected through the collar locator 16 and the cable 12 to a D.C. source at the surface. The path 20 is accordingly part of a firing circuit 22 leading to the perforating elements to be described hereinafter. The firing head assembly 18 is attached onto the top of a sub 24 and provides a passage 26 for a hot wire segment 28.

Below the sub 24 are a plurality of repeating sections 30 each comprising an initiator-perforating element assemblage 32. The assemblages 32 are substantially identical and comprise an internally threaded casing or housing 34 having one or more ports 36 therein for receiving the discharge end of a perforating element 38 which is illustrated as being of the shaped charge variety. An initiator or blasting cap 40 is disposed adjacent the shaped charge 38 for detonating the same in a conventional manner. The blasting cap 40 is provided with first and second wires or leads 42, 44 for purposes more fully explained hereinafter.

The lowermost assemblage 32 is conveniently armed in any suitable manner, as by grounding one of the blasting cap wires 42, 44 to the casing 34 and connecting the other blasting cap wire to the firing circuit 22. In the alternative, the lowermost assemblage 32 may initially be disarmed and provided with a mechanism for arming the same, e.g. means for sensing hydrostatic pressure in the bore hole outside the gun 10 for arming the assemblage when an appropriate borehole depth is reached. The lower end of the lowermost assemblage 32 is closed in any suitable manner, as by the provision of a bull plug as illustrated in FIG. 1.

The general plan of operation of this invention and of the prior art single wire-multiple shot perforating guns is that the hot wire side of the firing circuit includes a switch for each initiator-perforating element assemblage which completes a bypass circuit to the next lower assemblage while disarming its associated assemblage. Upon firing of the lowermost assemblage, the switch of the next upper assemblage is manipulated to arm its associated blasting cap initiator. Firing of the shots carried by the gun 10 then proceeds from the bottom of the gun toward the top thereof. As heretofore illustrated and described, the perforating gun 10 is of substantially conventional design and may be obtained commercially from Gearhart-Owen Industries, Inc. of Ft. Worth, Tex.

Figure 2:
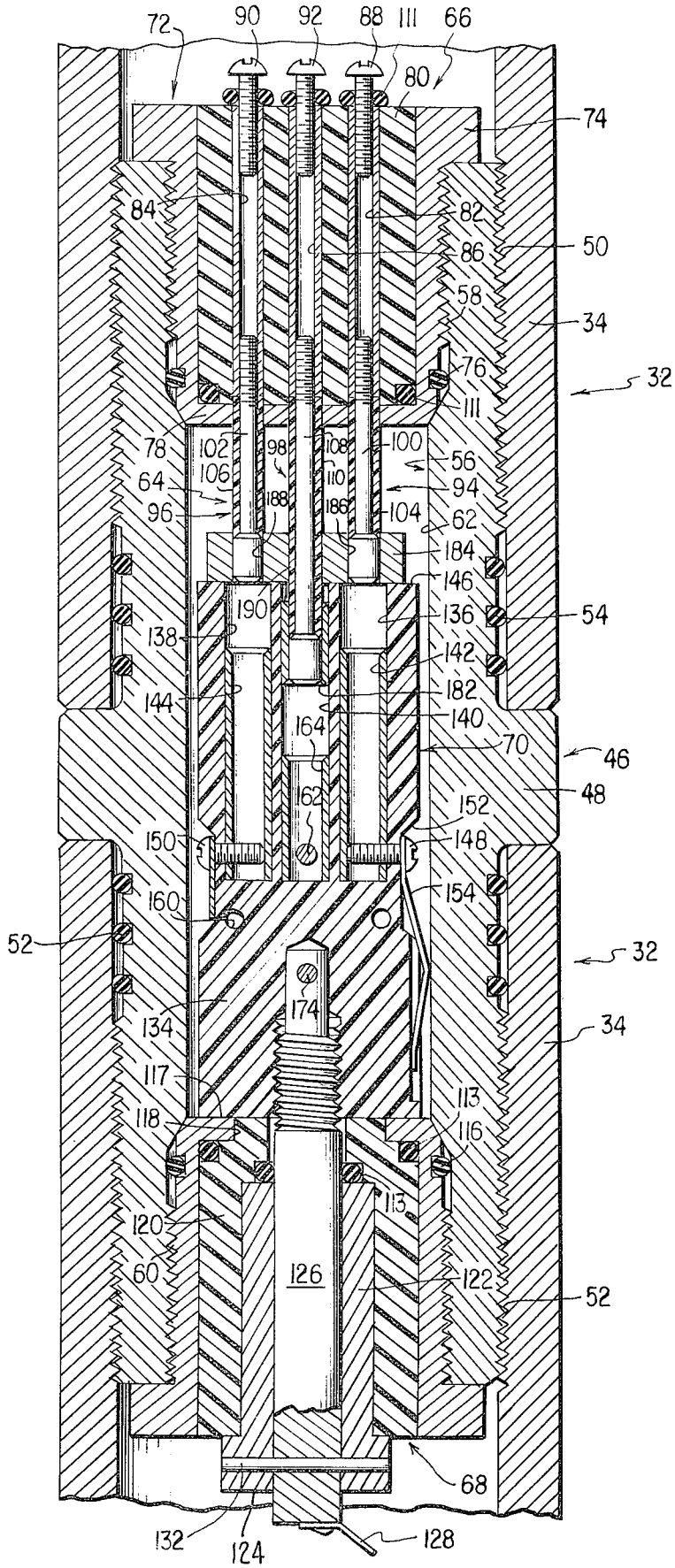
FIG. 2 is an enlarged cross-sectional view of an arming switch of this invention illustrating the same in the disarmed position.
Figure 3:
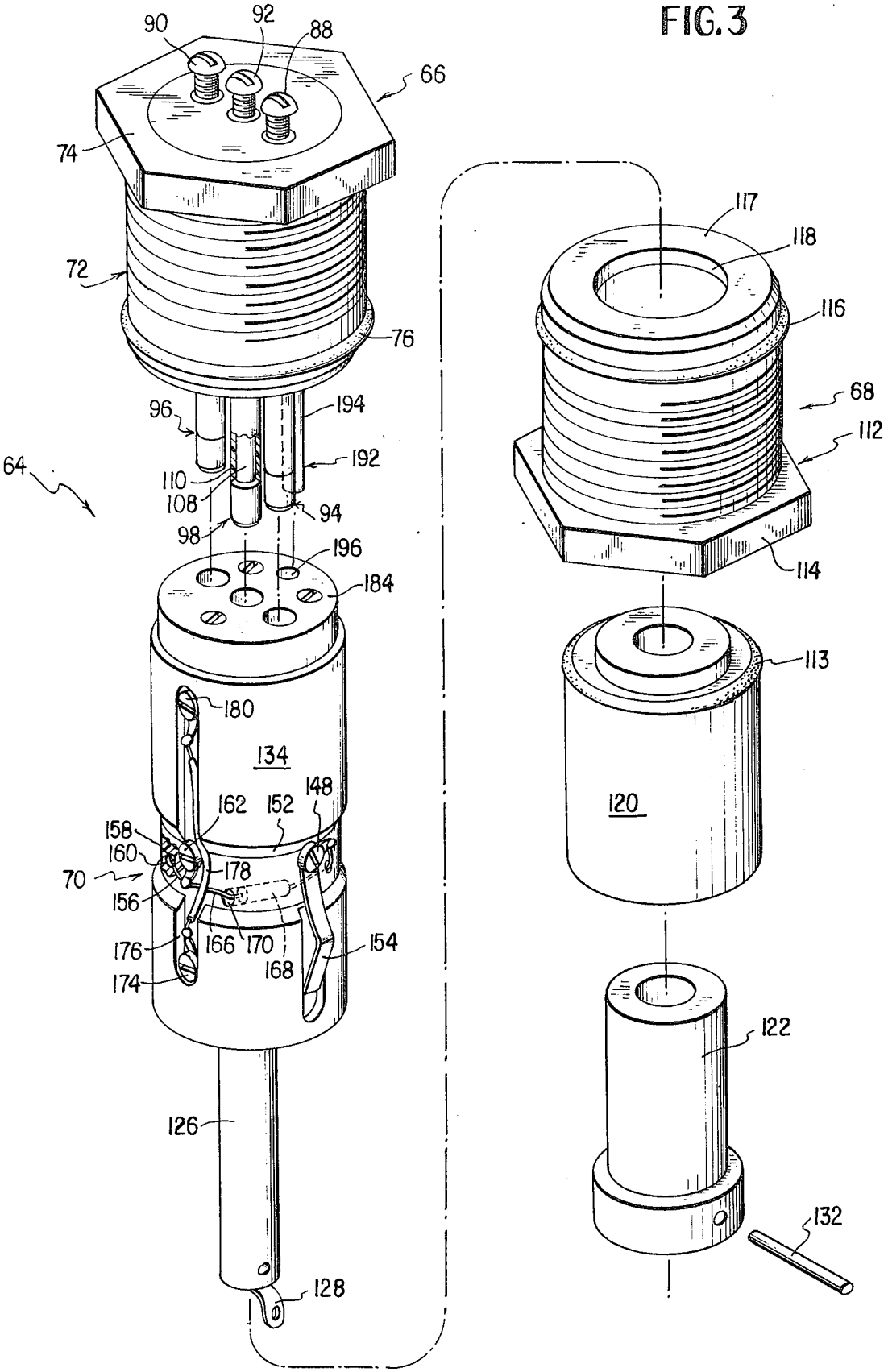
FIG. 3 is an exploded isometric view of the arming switch of this invention.

A switch sub 46 is connected between adjacent assemblages 32 and is illustrated more clearly in FIGS. 2 and 3. The switch sub 46 comprises a rigid body 48 suitably of machined metal or the like having upper and lower external threads 50, 52 for coupling with the adjacent assemblages 32. Suitable O-rings 54 seal between the body 48 and the adjacent assemblages 32 to prevent liquid passage into the gun 10. An elongate passage 56 extends axially through the switch sub 46 and comprises upper and lower internally threaded sections 58, 60 and a smooth circular section 62 therebetween. Although the threaded sections 50, 58 are denominated as upper and the threaded sections 52, 60 denominated as lower, it will be apparent that the switch sub 46 is symmetrical about a transverse axis and may be utilized with either end in the up position. As will be more fully apparent hereinafter, the switch mechanism of this invention is mounted in the passage 56.

Referring to FIGS. 2 and 3, there is illustrated a switch mechanism 64 of this invention. The switch 64 provides a multiplicity of functions during operation of the perforating gun 10 which may be broadly classified as disarming functions and arming functions. In the disarmed position of the switch 64, its associated blasting cap 40 is electrically separated from any contact with the firing circuit 22, an electrical bypass circuit is made through the switch 64 to provide a hot wire for a subjacent assemblage, and the terminals of its associated blasting cap 40 are short circuited. Included among the arming functions of the switch 64 are responding to the detonation of a subjacent perforating element to remove the short circuit between the blasting cap terminals, to place the blasting cap 40 in circuit with the hot wire and to sever the circuit leading to the subjacent fired assemblage.

To these ends, the switch 64 comprises an upper or first stationary section 66, a lower or second stationary switch section 68 and a central or third switch section 70 which is movably mounted relative to the switch sections 66, 68. The upper section 66 comprises an externally threaded metal cap 72 sized to be received in the upper threaded passage 58 of the switch sub 46. The metal cap 72 comprises an outer flanged end 74 which is conveniently of hexagonal shape in order to receive a wrench. Suitable O-rings 76 are provided to seal between the metal cap 72 and the sub body 48. The metal cap 72 also comprises a perforated base 78.

The switch section 66 further comprises a dielectric body 80, which is desirably of phenolic resin, securely mounted in the end cap 72, either by casting in place or press fitting. The body 80 captivates at least three metallic conduits 82, 84, 86 which are conveniently interiorly threaded to receive screws 88, 90, 92 so that electrical connections may be made thereto adjacent the flanged end 74. Screwed into the opposite ends of the tubes 82, 84, 86 are three electrical prongs 94, 96, 98. The prongs 94, 96 are desirably of approximately the same length and comprise an electrically conductive central rod 100, 102 having an electrically insulating coating 104, 106 extending from the dielectric body 80 to the location spaced from the end of the respective rod 100, 102. It is accordingly apparent that the exterior of the prongs 94, 96 are electrically conductive only adjacent the ends thereof.

The prong 98 is of somewhat similar construction although desirably of somewhat greater length. The prong 98 accordingly comprises an electrically conductive central rod 108 having an electrically insulating coating 110 extending from the dielectric body 80 to a location spaced from the end of the rod 108. Accordingly, the exterior of the prong 98 is electrically conductive only adjacent the end thereof.

It is desirable to provide means for preventing liquid leakage through the upper and lower switch sections 66, 68. To this end, suitable seals such as O-rings 111, 113 may be provided as desired.

The second switch section 68 comprises an externally threaded metal end cap 112 similar to the end cap 72 and designed to be threadably received by the passage section 60. The end cap 112 comprises a flanged end 114 which is suitably of hexagonal shape for receiving a wrench. Suitable O-rings 116 are provided to seal between the end cap 112 and the sub body 48 to prevent pressure from the detonating perforating element immediately below from reaching the interior of the switch 64. The end cap 112 also comprises a base wall 117 having an enlarged opening 118 therein.

The switch section 68 comprises a dielectric body 120, preferably of phenolic resin in order to withstand high temperatures and pressures, into which is cast or press fit a metal sleeve 122 having a shoulder 124 beyond the end of the dielectric body 120. The sleeve 122 terminates well short of the end cap base to prevent electrical contact therebetween.

The central or movable switch 70 is sized to reciprocate easily in the passage 62 between a first or disarmed position illustrated in FIG. 2 and a second or armed position in which the prongs 94, 96, 98 are fully received within the switch section 70.

The switch section 70 comprises an elongate electrically conductive rod 126 having a terminal 128 thereon for wiring to a hot wire segment 130 leading to a subjacent assemblage 32. The rod 126 is mounted in the sleeve 122 for sliding movement and is captivated thereto by a shear pin 132. The movable switch section 70 is accordingly captivated to the second switch section 68 in the disarmed position. The rod 126 is captivated in a dielectric body 134 of the switch section 70 which provides a plurality of passages 136, 138, 140 at the opposite end thereof aligned respectively with the prongs 94, 96, 98.

Inside the passages 136, 138 are a pair of metallic sleeves 142, 144 which are spaced substantially from the end 146 of the body 134. The sleeves 142, 144 are respectively connected to a screw 148, 150 extending radially of the body 134 and terminating in a circumferential groove 152. Attached to the screw 148 is a grounding spring 154 which engages the passage 62. As will be more fully pointed out hereinafter, the sub body 48, the assemblage casing 34 and the bulk of the gun 10 is grounded through the cable 12. A wire 156 is connected to the screw 150 and is connected to a diode 158 housed in a passage 160 in the body 134. The wire 156 connects to a screw terminal 162 extending into the body 134 into electrical engagement with a sleeve 164 positioned in the passage 140. A wire 166 connects the screw terminal 162 to the screw terminal 148 an includes therein a resistor element 168 housed in a passage 170 in the body 134.

A screw terminal 174 extends from a slot 176 in the exterior of the body 134 into electrical connection with the rod 126. A wire 178 extends from the terminal 174 along the exterior of the body 134 into connection with a screw terminal 180 extending into the body 134 into electrical connection with a sleeve 182 disposed in the passage 140 and separated from the sleeve 164. It will accordingly be seen that there is an electrical bypass between the rod 126, the sleeve 182 and the screw terminal 92 in the disarmed position in FIG. 1.

Disposed adjacent the end 146 of the body 138 is an electrically conductive disc 184 having openings 186, 188 therein for receiving the conductive ends of the prongs 94, 96 in the disarmed position of the switch 64. A passage 190 is provided to receive and pass the prong 98. Since the electrically insulating coating 110 of the prongs 98 is disposed in the passage 190, there is no electrical communication between the prong 98 and the disc 184.

As shown best in FIG. 3, suitable supplementary guide means 192 may be provided to assure that the switch section 70 moves linearly relative to the switch section 66. It will be apparent that the prongs 94, 96, 98 and the respective passages 136, 138, 140 and the sleeves therein act partially as guides. Although the supplementary guide means 192 may be of any suitable type, the first switch section 66 may conveniently comprise a probe or prong 194 which is received by a passage 196 in the movable switch section 70. The prong 194 is preferably at least as long as the prong 98 and desirably fits moderately snugly in the passage 196.

During assembly of the perforating gun 10 in a shop, the movable switch section 70 is conveniently stabbed onto the first switch section 66 which is then threaded into one end of the switch sub 46. The second switch section 68 is then passed over the end of the rod 26 and threaded into the opposite end of the switch sub 46. The conductive rod 126 is then pulled to place the opening therethrough in position to receive the shear pin 132. Accordingly, it is assured that the prongs 94, 96 are short circuited by the disc 184 while the prong 98 is in electrical connection with the sleeve 182. The switch sub 46 is then assembled along with the initiator-perforating element assemblages 32 and the remainder of the perforating gun 10 in a more-or-less conventional manner wherein the blasting cap leads 42, 44 are attached to the screw terminals 82, 84 respectively, the lead 130 to the subjacent assemblage 32 is connected to the terminal 128, and the lead 130 to the superposed assemblage 32 is connected to the terminal 92.

Figure 4:
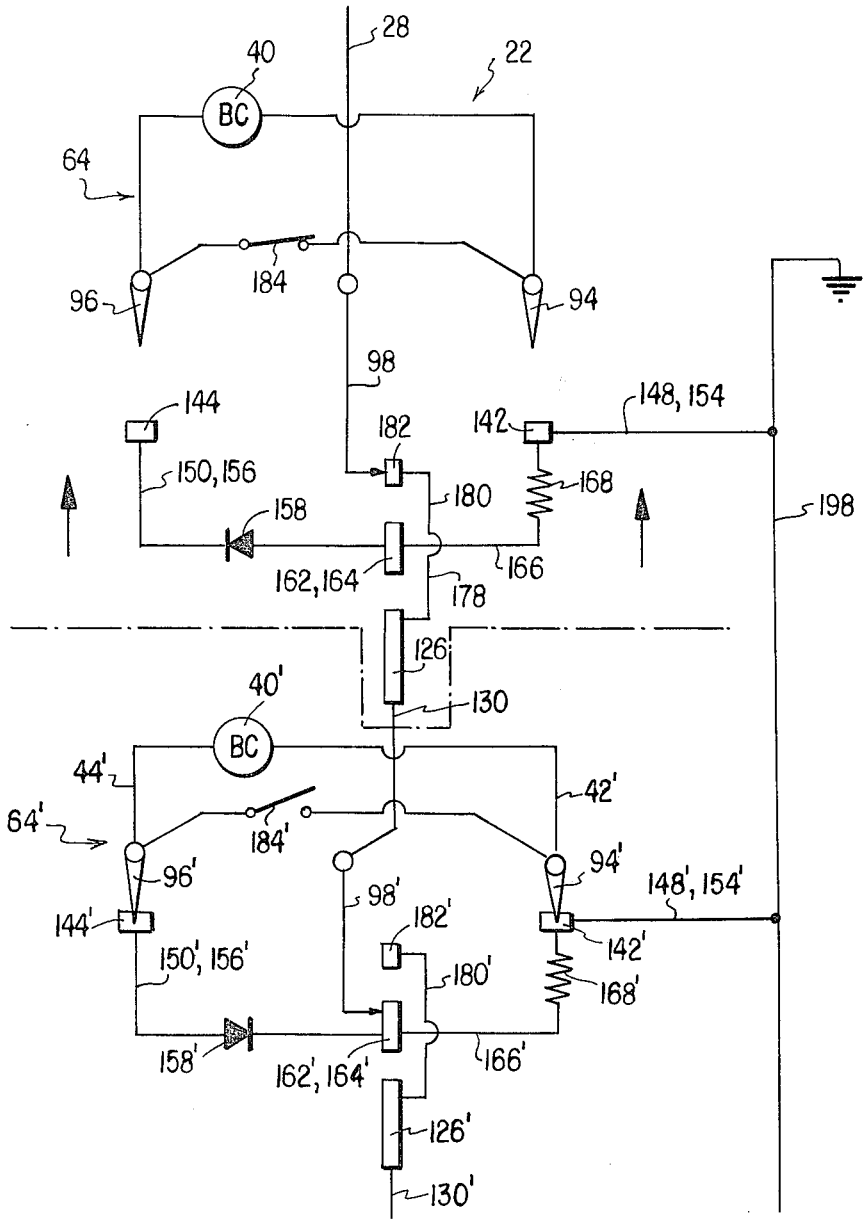
FIG. 4 is a schematic diagram of two adjacent switches of this invention illustrating one of them in a disarmed position and the other in an armed position.

The lowermost initiator-perforating element assemblage 32 is typically armed before the gun 10 is run in the hole. After the gun 10 is located vertically in the well at a desired location, a D.C. firing current of suitable polarity is applied to the firing circuit 22 to pass the diode associated with the lowermost assemblage 32. Upon firing of the lowermost blasting cap 38 in FIG. 1, the lowermost movable switch section 70' is driven upwardly to arm the next higher assemblage 32. Referring to FIG. 4 in which the elements of the lowermost switch 64' are designated with primed reference characters, it will be apparent that the blasting cap 40' is armed since the prongs 94', 96' are no longer short circuited and since the hot wire 130 is connected through the prongs 98' to the sleeves 142', 144'. Arming of the switch 64' occurs almost immediately upon firing of the lowermost assemblage. Thus it is extremely difficult, if not impossible, to prevent firing current of the lowermost assemblage from reaching the diode 158'. In manually fired perforating guns, the operator simply cannot get his finger off the firing button fast enough. Although the opposite polarity of the diodes should prevent inadvertant firing of the next higher assemblage, the resistor 168' provides a leakage path for the firing current of the lowermost assemblage. In the alternative, the resistor 168' may be replaced by a diode of opposite polarity to the diode 158' to allow firing current of opposite polarity to leak off.

When it is desired to fire the blasting cap 40', an operator at the surface applies a signal through the cable 12 into the hot wire 28 and into the first or upper switch 64 through the prong 98, the sleeve 182, the screw terminal 180, the wire 178 and the electrically conductive rod 126. The firing current leaves the upper switch 64 along the wire 130 into the subjacent or lower switch 64'. Since the lowermost switch 64' is armed, firing current passes through the sleeve 164', the wire 156', the diode 158', the screw terminal 150', the sleeve 144', the prong 96' and the wire 44' to detonate the blasting cap 40'. The firing circuit is completed by the wire 42', the prong 94', the sleeve 142', the screw terminal 148' and the grounding spring 154' which rubs against the inside of the passage 62 thereby placing the circuit in contact with a ground connection 198 comprising part of the body of the gun 10 which is connected through the cable 12 to a suitable ground near the surface of the well.

When the blasting cap 40' detonates and its associated shaped charge is ignited, a pressure wave is generated inside the casing 34 to which the end of the rod 126 is exposed. The rod 126 accordingly becomes a piston-like element and generates sufficient force during detonation of the shaped charge to shear the pin 132. As suggested by the dangling wire 130' in FIG. 4, the wire 130 is at least partially destroyed. The rod 126 moves upwardly as viewed in FIGS. 2 and 3 to drive the movable switch section 70 to an upper position in which the prongs 94, 96, 98 are wholly received in the passages 136, 138, 140. Accordingly, the blasting cap 40 of the upper switch 64 is now armed and may be fired upon application of a D.C. signal to the hot wire 28 which is of opposite polarity as is apparent from the opposite orientation of the diodes 158, 158' in FIG. 4.

Figure 5:
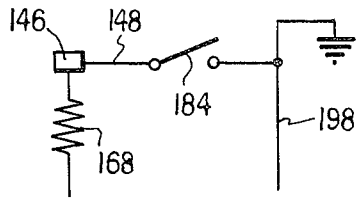
FIG. 5 is a partial schematic diagram, similar to FIG. 4, illustrating another embodiment of the invention.

Referring to FIG. 5, there is schematically illustrated another embodiment of the invention. By deleting the grounding spring 154 and wiring the terminal 148 to the metallic disc 184, as by the use of a wire passing vertically in FIG. 3 through an exterior slot (not shown) in the body 134, there is no ground connection provided in the disarmed position of the switch 64. When the switch section 70 moves vertically in response to a detonation and the disc 184 comes into contact with the metallic end cap 72, a ground connection is established.

The importance of a short circuit between the blasting cap leads 42, 44 should not be minimized. Blasting caps are shipped through normal freight channels with the only precaution being that the leads thereof are in electrical contact with one another. It is thus recognized that this technique provides an explosive device which is quite safe to handle and exceedingly unlikely to fire inadvertantly. Although the heretofore disclosed technique for breaking the short circuit is primarily mechanical in nature, electrical techniques are also available, for example, by placing a fuse across the terminals 88, 90 which opens upon application of firing current to the firing circuit 22.

It is apparent that the disarmed blasting caps 40 are wholly electrically separated from the firing circuit 22 since each lead 42, 44 is provided with a separate switch element separating the lead from the circuit 22. It will accordingly be apparent that there is little likelihood of a stray electrical current firing the blasting cap 40 until it is armed.

It will also be apparent that reloading the perforating gun 10 is quite convenient and inexpensive since all of the mechanisms of the switch 64 are reusable and are not damaged in any fashion by the use thereof. Accordingly, one need only replace the blasting caps 40, the shaped charges 38 and the wiring 42, 44, 130 associated therewith.

I claim:

1. A perforating gun comprising a plurality of normally disarmed electrically fireable initiator-perforating element assemblages and means providing an armed electrically fireable initiator-perforating element assemblage; and means for sequentially firing the assemblages including circuit means including first and second elongate electrical conductors for providing electrical communication between the earth's surface and the perforating gun when it is run in a well for electrically firing any armed assemblage;

means associated with each disarmed assemblage for electrically separating the initiator thereof from contact with the first electrical conductor;

means associated with each disarmed assemblage for electrically separating the initiator thereof from contact with the second electrical conductor; and means responsive to firing of each armed assemblage for arming one of the disarmed assemblages including means placing the initiator of the one disarmed assemblage in circuit with the firing circuit means including the first and second electrical conductors.

2. The perforating gun of claim 1 further comprising means short circuiting the initiators of the disarmed assemblages and wherein the arming means includes means for deactivating the short circuiting means of the initiator of the one disarmed assemblage.

3. The perforating gun of claim 1 wherein the initiator includes a pair of electrical leads and the separating means comprises a switch element for separating each lead from contact with the firing circuit means.

4. The perforating gun of claim 1 wherein the arming means comprises a switch for each disarmed assemblage for connecting the initiator thereof in circuit with the firing circuit means and including a housing of sufficient strength to withstand forces generated during firing, first and second switch sections mounted in the housing for relative movement between a first normal position disarming an associated initiator and a second position arming the associated initiator, and means operative across the housing wall for sensing the firing of the adjacent assemblage for moving the switch sections to the second position.

5. The perforating gun of claim 4 wherein the switch is disposed below the initiator associated therewith and the last mentioned means is exposed to pressures generated by the firing of the subjacent assemblage.

6. The perforating gun of claim 4 wherein the initiator-perforating element assemblages each comprise a casing, the switch housings being connected between adjacent casings and comprising means preventing pressure generated during firing of one assemblage from reaching an adjacent unfired assemblage.

7. A perforating gun comprising a plurality of normally disarmed electrically fireable initiator-perforating element assemblages and means providing an armed electrically fireable initiator-perforating element assemblage; and means for sequentially firing the assemblages including circuit means including first and second elongate electrical conductors for providing communication between the earth's surface and the perforating gun when it is run in a well for electrically firing any armed assemblage;

means associated with each disarmed assemblage for electrically separating the initiator thereof from contact with the first electrical conductor;

means associated with each disarmed assemblage for electrically separating the initiator thereof from contact with the second electrical conductor;

means associated with each disarmed assemblage for short circuiting the initiator thereof; and means for arming one of the disarmed assemblages including means deactivating the short circuiting means of the initiator of the one disarmed assemblage and means placing the initiator of the one disarmed assemblage in contact with the firing circuit means including the first and second electrical conductors.

8. A perforating gun of claim 7 wherein the arming means comprises means responsive to firing of an armed assemblage for deactivating the short circuiting means of the initiator of the one disarmed assemblage and for placing the initiator of the one disarmed assemblage in circuit with the firing circuit means including the first and second electrical conductors.

9. A perforating gun comprising a plurality of spaced normally disarmed electrically fireable initiator-perforating element assemblages; and means for firing the assemblages including circuit means including first and second electrical conductors for electrically firing any armed assemblage;

means for electrically separating the initiator of each disarmed assemblage from contact with the first electrical conductor;

means for electrically separating the initiator of each disarmed assemblage from contact with the second electrical conductor; and means for arming the disarmed assemblages including means for placing the initiator of the disarmed assemblages in circuit with the firing circuit means including the first and second electrical conductors.

10. The perforating gun of claim 9 further comprising means short circuiting the initiators of the disarmed assemblages and the arming means includes means for deactivating the short circuiting means.

11. An explosively operated well tool comprising an elongate housing, runable into a well, carrying an electrically fireable explosive device having a pair of electrical terminals;

firing circuit means including first and second elongate electrical conductors for electrically firing the device;

means associated with the device for electrically separating the terminals from contact with the first and second electrical conductors thereby disarming the device; and means for arming the device in the well including means for placing the terminals of the device in circuit with the firing circuit means including the first and second electrical conductors.

12. The well tool of claim 11 further comprising means short circuiting the terminals of the device and the arming means includes means for deactivating the short circuiting means.

* * * * *